US005964275A

United States Patent [19]

Flick et al.

[11] Patent Number: 5,964,275

[45] Date of Patent: Oct. 12, 1999

[54] APPARATUS FOR THE PRODUCTION OF A STRIP, A PRE-STRIP OR A SLAB

[75] Inventors: Andreas Flick, Linz; Gerlinde Djumlija, Haid, both of Austria

[73] Assignee: Voest-Alpine Industrieanlagenbau GmbH, Linz, Austria

[21] Appl. No.: 08/951,080

[22] Filed: Oct. 15, 1997

Related U.S. Application Data

[63] Continuation of application No. 08/610,970, Mar. 1, 1996, Pat. No. 5,810,069, which is a continuation of application No. 08/182,630, Jan. 14, 1994, abandoned.

[30] Foreign Application Priority Data

Feb. 16, 1993 [AT] Austria ..... 292/93

[51] Int. Cl.[6] ..... B22D 11/12; B21B 1/46

[52] U.S. Cl. ..... 164/417; 164/476; 29/33 C

[58] Field of Search ..... 164/476, 477, 164/413, 414, 417; 29/527.7, 33 C

[56] References Cited

U.S. PATENT DOCUMENTS

| | | | |
|---|---|---|---|
| 5,018,569 | 5/1991 | Burau et al. | 164/476 |
| 5,303,766 | 4/1994 | Kreijger et al. | 164/476 |
| 5,488,987 | 2/1996 | Di Giusto et al. | 164/476 |

FOREIGN PATENT DOCUMENTS

| | | | |
|---|---|---|---|
| 9200815 | 1/1992 | European Pat. Off. . | |
| 5-69088 | 3/1993 | Japan | 164/476 |

*Primary Examiner*—Patrick Ryan
*Assistant Examiner*—I.-H. Lin
*Attorney, Agent, or Firm*—Ostrolenk, Faber, Gerb & Soffen, LLP

[57] ABSTRACT

There is disclosed an arrangement and for alternatively producing a hot-rolled strip, a hot-formed pre-strip or an unformed slab, of steel by the continuous casting method. In order to obtain a high product quality for strips as thin as possible and to ensure a high operational flexibility, the following characteristic features are realized individually or in combination:

casting of a strand at slab thickness in an open-ended mold having a continuously constant cross section, a first forming step including forming of the strand having a liquid core to reduce its thickness, a second forming step including forming of the already completely solidified strand to further reduce its thickness to pre-strip format, and a third forming step including forming of strand pieces separated from the strand by hot-rolling the strand pieces.

22 Claims, 1 Drawing Sheet

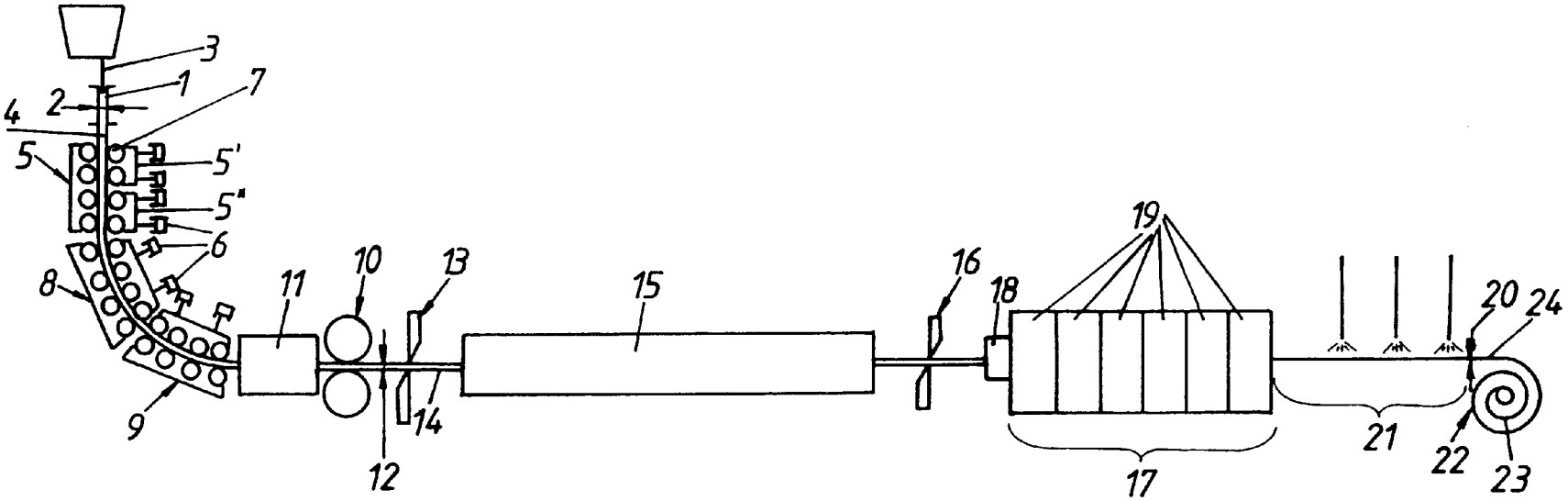
1
2
3
4
5
5'
5"
6
7
8
9
10
11
12
13
14
15
16
17
18
19
20
21
22
23
24

APPARATUS FOR THE PRODUCTION OF A STRIP, A PRE-STRIP OR A SLAB

This is a continuation of application Ser. No. 08/610,970, filed on Mar. 1, 1996 now issued as U.S. Pat. No. 5,810,069, which is a continuation of application Ser. No. 08/182,630, filed on Jan. 14, 1994, now abandoned.

FIELD OF THE INVENTION

The invention relates to a process for alternatively producing a hot-rolled strip, a hot-formed pre-strip or an as-cast slab of steel by means of the continuous casting method, as well as to an arrangement for carrying out the process.

DESCRIPTION OF THE RELATED ART

A process for producing a hot-rolled strip having a thickness as slight as possible by means of the continuous casting method and subsequent rolling of the continuously cast product is known from PCT-publication WO 92/00815. There, the cast product, after emergence from the open-ended mold, is subjected to a first forming step in which the cast product still has a liquid core. After complete solidification a further forming step is carried out by rolling the completely solidified cast product, which subsequently is heated to hot-rolling temperature and wound on a coil. After this, finishing hot-rolling is effected.

The known process not only calls for a structurally complex arrangement, but also is complicated in terms of control engineering, requiring a plurality of control engineering means for its realization. Accordingly, considerable investment expenditures are involved. Moreover, the extent of production uncertainties is high, because, due to the large number of constantly intervening driving aggregates, the overall process is stopped at a failure of only part of the same, the casting procedure, thus, having to be interrupted.

No flexibility with regard to product quality and quality of the manufacturing products produced is offered by the known process. Thus, for instance, the first forming step must be carried out every time, since, otherwise, the thinness of the product required for winding and hence production cannot be ensured. Therefore, the known process is not applicable to certain steel grades. Furthermore, concerted and flexible temperature control with regard to the quality of the finished product is hardly possible, in particular at unsteady conditions. In addition, the overall process is immediately stopped at a failure of the winding aggregate; this also involves a standstill of the casting process.

A process for producing a strip having a thickness ranging between 2 to 25 mm is known from EP-B-0 286 862. In this known process, a steel strand is formed by casting melt into a funnel-shaped open-ended mold and is formed already while passing through the same. The strand still having a liquid core, after having left the open-ended mold, is pressed in a manner that the internal walls of the already solidified strand shells weld together. Thereby, a reduction in thickness to a thickness of below 25 mm is achieved. However, this known process is applicable to quite specific steel grades only, i.e., those which allow for such forming closely below the open-ended mold.

Another disadvantage of that process resides in the fact that the still thin strand shell, on its way through the mold, is strongly squeezed, which may involve wrinkling and overthrusting of the strand shell. It is also possible that liquid exogenous or endogenous non-metallic components are pressed into the soft strand shell by the relative movement between the copper wall of the mold and the strand shell.

In addition, frictional forces are increased to an uncontrollable extent by the forming procedure occurring within the mold. The funnel-shaped open-ended mold does not allow for a uniform flow distribution, i.e., the strand shell, which is heavily stressed anyhow, can be weaked by melting open on the critical forming sites by the casting jet emerging from the submerged tube, which is reflected in an increased risk of breakout. A further disadvantage resides in the very low flexibility in respect of production capacity and with regard to utilizing the full casting speed range.

From EP-B-0 327 854 a process for rolling pre-strips cast on a strip caster is known, wherein the cast pre-strip is brought to rolling temperature in a continuous operating cycle and is introduced into the finishing rolling train for rolling out.

In order to avoid interruption of production in case of a failure in the finishing rolling train or in the coiling arrangement, it is known from that document to roll the cast pre-strip to coarse-plate thickness in the finishing rolling train as an alternative to hot-strip rolling, to cool it afterwards, to cut it to length and to stack it. However, with this known process it is not possible to produce thin strips when departing from a relatively large strand thickness.

SUMMARY OF THE INVENTION

The present invention aims at avoiding the above-described disadvantages and difficulties and has as its object to provide a process as well as an arrangement for carrying out the process, which enable the production of strips as thin as possible at a high product quality while offering a very high operational flexibility. In particular, it is to be possible to continue continuous casting in case of a failure at a forming stage arranged to follow the open-ended mold.

In accordance with the invention, this object is achieved by the combination of the following characteristic features:

- casting of a strand at slab thickness, preferably at a thickness ranging between 60 and 150 mm, in particular between 60 and 100 mm, in an open-ended mold having a continuously constant cross section,
- a first forming step including forming of the strand having a liquid core to reduce its thickness,
- a second forming step including forming of the already completely solidified strand to further reduce its thickness to pre-strip format, and
- a third forming step including forming of strand pieces separated from the strand and preferably having pre-strip format, by hot-rolling the strand pieces, wherein
- for the production of a strip as thin as possible, all of the forming steps are applied in sum,
- for the production of a strip having a slightly larger thickness, only the forming steps provided after complete solidification of the strand are carried out individually or in sum, and
- if desired, unformed (i.e., "as-cast") slabs are produced by eliminating all of the forming steps.

According to the process of the invention, plate molds having plane-parallel walls may be employed. In connection with a submerged tube, this results in the formation of a uniform strand shell. The strand shell is neither deformed nor squeezed in the open-ended mold, because the latter has a continuously constant cross section. Due to the steady operating conditions prevailing within the open-ended mold (homogenous conditions, such as uniform lubrication and uniform cooling), the strand emerging from the open-ended mold has a strand shell of supreme quality such that the risk of breakout is minimized and forming of the strand still having a liquid core is feasible without any risk of breakout.

The high flexibility of the process is reflected in the possibility of obtaining small hot-strip thicknesses by one and the same arrangement and with an equal number of rolling stands, by reducing the pre-strip thickness according to demands.

For the production of a strip, the first and second forming steps preferably are carried out individually or jointly as a function of the steel grade and under consideration of the forming properties of the latter at the temperature conditions prevailing during these forming steps, wherein suitably only the second and third forming steps are carried out for high-alloy or high-carbon structural steels, for high-strength tube steels, for austenitic steels and for duplex steels.

According to a preferred embodiment, the first forming step is carried out immediately upon emergence of the strand from the mold, said first forming step advantageously being carried out in a plurality of partial steps. Accordingly, the first forming stage preferably is made up of a plurality of forming segments, and the partial forming steps are carried out in at least some of the forming segments.

Suitably, the second forming step is preceded by descaling.

Suitably, temperature homogenization of the separated strand pieces is effected before the third forming step.

Due to the high flexibility of the process according to the invention, a reduction of the thickness of the strand down to a thickness of 30 mm or a thickness thereabove preferably is effected by the first two process steps applied individually or jointly. Thus, the separated strand piece has a thickness of at least 30 mm before being conducted to further rolling. In case the first two forming steps are eliminated, this thickness may amount to the casting thickness, i.e., preferably 150 mm at most, in particular 100 mm.

An arrangement for carrying out the process according to the invention is characterized by the combination of the following characteristic features:

- an open-ended mold having a continuously constant cross section,
- a first forming stage provided in the region below the mold in which the strand has a liquid core,
- a second forming stage provided in the region in which the strand has already completely solidified,
- a third forming stage formed by a one- or multi-stand hot-rolling stand, and
- a separating means provided between the second and third forming stages for the production of strand pieces separated from the strand,
- said forming stages being activatable individually, in twos or altogether.

Preferably, the first forming stage comprises rollers causing the formation of the strand, which rollers are hydraulically adjustable relative to one another.

Advantageously, a means for the temperature homogenization of the separated strand pieces, such as a temperature equalization furnace, is provided between the separating means and the third forming stage, the means for temperature homogenization suitably being provided with a storage means for accommodating several separated strand pieces.

In the following, the invention will be explained in more detail by way of the appended drawing figure in the form of a schematic sketch illustrating an exemplary embodiment.

BRIEF DESCRIPTION OF THE DRAWING

The sole drawing FIGURE appended hereto is a schematic sketch of an exemplary embodiment of the apparatus according to the present invention.

DETAILED DESCRIPTION OF THE PREFERRED EMBODIMENTS

Referring to the Figure, open ended mold for continuously casting strands, which has a continuously constant cross section and preferably is designed as a plate mold, is denoted by 1. By this open-ended mold, cast strands having thicknesses 2 that range betwen 60 and 150 mm, preferably between 60 and 100 mm (so-called thin slabs), can be cast. With open-ended molds of such thicknesses, the use of a conventional submerged tube 3 is feasible, as a result of which steady operating conditions in terms of cooling and melt distribution are created such that the strand 4 leaving the open-ended mold 1 has a uniform and solidly developed strand shell.

Below the open-ended mold 1, which preferably is designed as a straight mold, a vertical supporting stand 5 is arranged constituting a first forming stage, which supporting stand comprises supporting rollers 7 that are hydraulically adjustable to the strand shell (as is indicated by pressure-medium cylinders 6). This vertical supporting stand is subdivided into two partial segments 5', 5" such that different forces are applicable on the strand 4 by each of the partial segments. By aid of this vertical supporting stand 5, a socalled "soft reduction" of the solidifying strand 4 still having a liquid core is carried out as the first forming step, the stress exerted on the strand shell in the two-phase boundary layer remaining below the ultimate elongation affecting the final product quality. By means of this so-called "soft reduction", a reduction of the strand thickness by as much as 30 mm may be obtained without quality losses. Additional arc segments 8, 9 are provided to follow the vertical segment 5, which optionally also comprise hydraulically adjustable supporting rollers 7.

After deflection of the strand 4 into the horizontal line, the strand is conducted through a single-acting (optionally multi-stage) forming stand 10, which can be activated as the second forming stage (second forming step) for the formation of the already completely solidified strand 4. Thereby, a thickness 12 of a pre-strip according to the hot-strip thickness required is obtained at a pass reduction of up to a maximum of 60% (e.g.: 70 to 30 mm).

Before passing through the forming stand 10, the strand 4 is subjected to descaling in a descaling means 11 enabling soft descaling by means of rotating descaling nozzles as well as by special water stripping means for the descaling water.

The prereduction in thickness allows for influencing the final product quality prior to temperature equalization, in particular for micro-alloyed steels, which usually are influenced by appropriate pass reductions above the recrystallization stop temperature, by precipitation and recrystallization procedures.

After prereduction, the strand 4 preferably has the format of a pre-strip, i.e., of a (non-windable) prematerial suitable for the production of strips. The thickness 12 preferably is 30 mm and more.

Following upon the forming stand 7, there is provided a separating means 13 for cutting the cast strand 4 to length, wherein the strand 4 formed in the continuous caster according to the demands set on the final product is separated into lengths corresponding to the coil weights by means of hydraulic shears.

The thus-formed strand pieces 14 having thicknesses of from 30 to 150 mm (the latter holding for an unformed strand of maximum thickness) then are introduced into a transportation and homogenization device, e.g., a roller hearth 15, which, according to the respective slab temperature, also is able to heat a thin slab. In this roller hearth 15, the entire cross section of the strand piece 14, in particular its edges, is brought to uniform temperature. The strand pieces may be buffered (stored, e.g., by stacking) in this furnace aggregate 15, i.e., in case of short-term failures in a plant part thin slabs or strand pieces 14 are placed there until the production process is resumed.

Following the roller hearth 15, there is provided a further separating means designed as a hydraulic shearing means 16, which is activated in case of a failure in the consecutive rolling mill stage 17 functioning as the third forming stage. Before entering the rolling mill stage 17, descaling is effected in a descaling means 18, which preferably is formed by a rotor descaling means involving low water consumption and hence slight temperature drops at excellent descaling rates.

After this, rolling of the strand pieces takes place in the rolling mill stage 17, which is comprised of finishing stands 19. The number of finishing stands 19 of the finishing train is a function of the thickness 12 of the strand pieces 14 after separation from the cast strand 4, and of the thickness of the strip 20 to be cast. The strand pieces 14 do not undergo $\gamma$-$\alpha$ transformation until that point of time in the production process at which $\gamma$-$\alpha$ transformation is required, on account of material-inherent procedures, to obtain the mechanical-technological parameters sought as well as the respective impact strength for the steel grade produced.

For smaller capacities, the finishing train may be replaced with a Steckel mill. This facility preferably is applied to producing hot strips of stainless steel or special steel, from thin slabs.

After having left the rolling mill stage 17, the rolled strand piece 14 is cooled to coiling temperature in a cooling train 21 (laminary cooling train) and is wound to a coil 23 by means of a coiler 22. The finished rolled strip is denoted by 24.

By the possibility of combining the three forming stages provided in accordance with the invention, the overall plant flexibility is increased, since the overall process remains in operation without any losses of quality or output even without "soft reduction" (first forming step) with liquid sump and/or without rolling upon complete solidification (second forming step). Thus, for instance, with the present arrangement activation of all of the forming stages is necessary for only about 15 to 20% of the overall production, i.e., for that portion of production which is to be rolled to a final thickness that cannot otherwise be reached by the finishing train.

Furthermore, this configuration allows for the optimization of energy of the overall process by balancing out the casting thickness (D) and the final thickness (P) with a view to introducing into the roller hearth 15 as large an enthalpy of the strand pieces as possible. This is reached by a dynamic cooling policy by means of air-water nozzles to raise the exit temperature of the strand as well as by "soft descaling".

The usually-occurring textural changes do not occur in the process according to the invention, because the steel temperature does not fall to below the transformation temperature $Ar_3$. The procedures required for a fine and homogenous texture, which do not occur with specific steel grades, are compensated for by the instant plant parts by aid of preforming. Hence result advantageous new perspectives for the production of micro-alloyed steels by means of thin-slab technology.

The diversity of the process according to the invention is demonstrated in the following Table. In this Table, wherein the strip thicknesses are given in millimeters, the smallest strip thicknesses to be obtained at a casting thickness of 70 mm are indicated for different steel grades in horizontal lines, wherein it is additionally indicated which of the first two forming stages is activated. The first forming stage—at a thickness reduction of 10 mm—is denoted by I and the second forming stage—at a thickness reduction of 20 mm—is denoted by II. If the respective forming stage is activated, this is denoted by an X, if it is not activated, this is marked by an ○. N serves to indicate that the strip thicknesses in question are not to be produced by the process steps according to the invention alone. The third forming stage (rolling mill stage 17) is constantly in operation with five to seven finishing stands 19 for the dimensional ranges indicated in the Table.

| Type Repres. | Qualities | | Standard | 1,0 <1,2 | 1,2 <1,4 | 1,4 <1,6 | 1,6 <1,8 | 1,8 <2,0 | 2,0 <2,2 | 2,2 <2,4 | 2,4 <2,6 | 2,6 <2,8 |
|---|---|---|---|---|---|---|---|---|---|---|---|---|
| St 24 | Deep-drawing steel | I | DIN 1614, | X | X | 0 | 0 | 0 | 0 | 0 | 0 | 0 |
| –25 | with highest surface demands | II | T2 | X | X | X | X | 0 | 0 | 0 | 0 | 0 |
| IF, ULC, BH | motorcar, household | | | | | | | | | | | |
| St 22 | Deep-drawing and | I | DIN 1614, | X | X | 0 | 0 | 0 | 0 | 0 | 0 | 0 |
| –23 | drawing qualities | II | T2 | X | X | X | X | 0 | 0 | 0 | 0 | 0 |
| St 37 | Low-alloy structural steels | I | DIN 1623, | N | N | X | X | 0 | 0 | 0 | 0 | 0 |
| | | II | T2 | N | N | X | X | X | 0 | 0 | 0 | 0 |
| St 44– | Medium-alloy structural steels | I | DIN 17119, | N | N | N | X | 0 | 0 | 0 | 0 | 0 |
| St 52 | | II | 17120 | N | N | N | X | X | X | X | X | 0 |
| C 45– | High-carbon structural steels | I | DIN 17200, | N | N | N | N | N | N | 0 | 0 | 0 |
| C 70 | | II | 17201, 17204 17222 | N | N | N | N | N | N | X | X | X |
| QStE | Higher-strength | I | SEW 092 | N | N | N | N | X | X | 0 | 0 | 0 |
| 380–690 TM | structural steels | II | | N | N | N | N | X | X | X | X | X |
| 25 CrMo4 | Structural alloy steels | I | DIN 1652 T4 | N | N | N | N | N | N | 0 | 0 | 0 |
| 42 CrMo4 | | II | 1654 T4, 17200, 17204, SE 4550 | N | N | N | N | N | N | X | X | X |
| X52– | HSLA, tube steel | I | API Spec. | N | N | N | N | N | N | N | 0 | 0 |
| X 70 | | II | 5L (SPEC5L) | N | N | N | N | N | N | N | X | X |
| X5CrNi- | Austenites | I | DIN 17440 | N | N | N | N | N | 0 | 0 | 0 | 0 |
| 1810- | | II | to 17442 | N | N | N | N | N | X | X | X | X |
| X6CrNi- | | | | | | | | | | | | |
| Ti1810 | | | | | | | | | | | | |

-continued

| | | | | | | | | | | | | | |
|---|---|---|---|---|---|---|---|---|---|---|---|---|---|
| X6CrTi12 | Ferrite, Martensite | I | DIN 5512 T3, | N | N | N | N | N | X | X | 0 | 0 |
| –X6Cr17 | | II | DIN 1654 T5 | N | N | N | N | N | X | X | X | X |
| X4CrNi- | Duplex | I | SEW 400 | N | N | N | N | N | 0 | 0 | 0 | 0 |
| MoN2752 | | II | | N | N | N | N | N | X | X | X | X |

| Typ. Repres. | Qualities | | 2,8 <3,0 | 3,0 <3,2 | 3,2 <3,4 | 3,4 <3,6 | 3,6 <3,8 | 3,8 <4,0 | 4,0 <4,2 | 4,2 <4,4 | 4,4 <4,6 | 4,6 <4,8 | 4,8 <5,0 |
|---|---|---|---|---|---|---|---|---|---|---|---|---|---|
| St 24 | Deep-drawing steel | I | 0 | 0 | 0 | 0 | 0 | 0 | 0 | 0 | 0 | 0 | 0 |
| –25 | with highest surface demands | II | 0 | 0 | 0 | 0 | 0 | 0 | 0 | 0 | 0 | 0 | 0 |
| IF, ULC, BH | motorcar, household | | | | | | | | | | | | |
| St 22 | Deep-drawing and | I | 0 | 0 | 0 | 0 | 0 | 0 | 0 | 0 | 0 | 0 | 0 |
| –23 | drawing qualities | II | 0 | 0 | 0 | 0 | 0 | 0 | 0 | 0 | 0 | 0 | 0 |
| St 37 | Low-alloy structural steels | I | 0 | 0 | 0 | 0 | 0 | 0 | 0 | 0 | 0 | 0 | 0 |
| | | II | 0 | 0 | 0 | 0 | 0 | 0 | 0 | 0 | 0 | 0 | 0 |
| St 44– | Medium-alloy structural steels | I | 0 | 0 | 0 | 0 | 0 | 0 | 0 | 0 | 0 | 0 | 0 |
| St 52 | | II | 0 | 0 | 0 | 0 | 0 | 0 | 0 | 0 | 0 | 0 | 0 |
| C 45– | High-carbon structural steels | I | 0 | 0 | 0 | 0 | 0 | 0 | 0 | 0 | 0 | 0 | 0 |
| C70 | | II | X | X | X | 0 | 0 | 0 | 0 | 0 | 0 | 0 | 0 |
| QStE | Higher-strength | I | 0 | 0 | 0 | 0 | 0 | 0 | 0 | 0 | 0 | 0 | 0 |
| 380–690 TM | structural steels | II | X | X | X | X | X | X | X | X | X | X | X |
| 25 CrMo4 | Structural alloy steels | I | 0 | 0 | 0 | 0 | 0 | 0 | 0 | 0 | 0 | 0 | 0 |
| 42 CrMo4 | | II | X | X | X | X | X | X | X | X | X | X | X |
| X 52– | HSLA, tube steel | I | 0 | 0 | 0 | 0 | 0 | 0 | 0 | 0 | 0 | 0 | 0 |
| X 70 | | II | X | X | X | X | X | X | X | X | X | X | X |
| X5CrNi- | Austenites | I | 0 | 0 | 0 | 0 | 0 | 0 | 0 | 0 | 0 | 0 | 0 |
| 1810- | | II | X | X | X | X | X | X | X | X | X | X | X |
| X6CrNi- | | | | | | | | | | | | | |
| Ti1810 | | | | | | | | | | | | | |
| X6CrTi12- | Ferrite, Martensite | I | 0 | 0 | 0 | 0 | 0 | 0 | 0 | 0 | 0 | 0 | 0 |
| X6Cr17 | | II | X | X | X | 0 | 0 | 0 | 0 | 0 | 0 | 0 | 0 |
| X4CrNi- | Duplex | I | 0 | 0 | 0 | 0 | 0 | 0 | 0 | 0 | 0 | 0 | 0 |
| MoN2752 | | II | X | X | X | X | X | X | X | X | X | X | X |

What we claim is:

1. An arrangement for alternatively producing as a final product one of a hot-rolled strip, a hot-formed pre-strip, and an as-cast slab of steel in a continuous casting operation, which arrangement comprises in combination:

an open-ended mold constructed to cast a strand at a slab thickness;

a selectively-activatable first forming stage provided in a region below said open-ended mold, in which said strand has a liquid core;

a selectively-activatable second forming stage provided in a region in which said strand has completely solidified; and a selectively-activatable third forming stage provided in a region following said second forming stage and comprised of at least one hot-rolling stand;

wherein said continuous casting operation is adapted to operate without stoppage if any one or more of the first forming stage, the second forming stage, and the third forming stage is in a deactivated state.

2. An arrangement as set forth in claim 1, wherein said at least one hot-rolling stand comprises a plurality of rolling stands.

3. An arrangement as set forth in claim 1, wherein said first forming stage comprises rollers arranged to effect forming of said strand, said rollers being hydraulically adjustable relative to one another.

4. An arrangement as set forth in claim 1, further comprising a device for temperature homogenization of said separated strand pieces arranged between said separator and said third forming stage.

5. An arrangement as set forth in claim 4, wherein said device for temperature homogenization is comprised of a temperature equalization furnace.

6. An arrangement as set forth in claim 4, further comprising a storage buffer provided in said device for temperature homogenization and constructed to receive several of said separated strand pieces stacked for storage.

7. An arrangement as set forth in claim 1, wherein said open-ended mold has a continuously constant cross section.

8. An arrangement as set forth in claim 1, wherein said first forming stage is constructed to reduce said slab thickness.

9. An arrangement as set forth in claim 8, wherein said second forming stage is constructed to further reduce said slab thickness to a pre-strip format.

10. An arrangement as set forth in claim 1, further comprising a separator arranged between said second and third forming stages and constructed to produce strand pieces separated from said strand and destined for hot-rolling in said third forming stage.

11. An arrangement as set forth in claim 1, wherein said first forming stage comprises a vertical supporting stand which is subdivided into a plurality of partial segments, each partial segment being adapted to apply a force on said slab different from the force applied by each of the remaining plurality of partial segments.

12. An arrangement as set forth in claim 1, wherein said first forming stage further comprises arcuate roller stands in a region following said vertical supporting stand and before the region of said second forming stage.

13. An arrangement as set forth in claim 1, further comprising a coiler in a region following the region of the third forming stage to wind said strand into a coil.

14. An arrangement as set forth in claim 13, further comprising a cooling train provided in a region between said third forming stage and said coiler to cool said strand to a temperature suitable for coiling.

15. An arrangement as set forth in claim 1, wherein said second forming stage comprises a single-stage forming stand.

16. An arrangement as set forth in claim 1, wherein said second forming stage comprises a multi-stage forming stand.

17. An arrangement as set forth in claim 1, wherein said second forming stage is constructed to further reduce said slab thickness to a non-windable prematerial suitable for the production of strips.

18. An arrangement as set forth in claim 17, wherein the slab thickness is 30 mm or greater.

19. An arrangement as set forth in claim 1, further comprising operating instructions to be conveyed to the arrangement by which selected ones or all of said first, second and third stages are activated or deactivated in order to alternatively produce various, pre-determined thicknesses of one of the hot-rolled strip, the hot-formed pre-strip, and the as-cast slab of steel in the continuous casting operation.

20. An arrangement as set forth in claim 1, further comprising a selectively-activatable separator disposed between said second and third forming stages for activation in the event of a failure in said third forming stage.

21. An arrangement for alternatively producing one of a hot-rolled strip, a hot-formed pre-strip, and an as-cast slab of steel in a continuous casting operation, the arrangement comprising:

an open-ended mold having a continuously constant cross section and constructed to cast a strand at a slab thickness; and means for alternatively producing one of a hot-rolled strip, a hot-formed pre-strip, and an as-cast slab from said strand without stoppage of the continuous casting operation.

22. An arrangement as set forth in claim 21, further comprising coiling means for coiling a finished hot-rolled strip when the continuous casting operation is selected to produce said hot-rolled strip.

* * * * *